US010197359B1

(12) United States Patent
Toole et al.

(10) Patent No.: US 10,197,359 B1
(45) Date of Patent: Feb. 5, 2019

(54) GRIP-MOUNTED LASER SIGHT FOR A HANDGUN

(71) Applicant: Lumen Defense Products Inc, Oregon City, OR (US)

(72) Inventors: Robert Mark Toole, Beaverton, OR (US); Paul Imholt, Molalla, OR (US)

(73) Assignee: Lumen Defense Products Inc, Oregon City, OR (US)

( * ) Notice: Subject to any disclaimer, the term of this patent is extended or adjusted under 35 U.S.C. 154(b) by 0 days.

(21) Appl. No.: 16/035,858

(22) Filed: Jul. 16, 2018

Related U.S. Application Data

(60) Provisional application No. 62/533,049, filed on Jul. 15, 2017.

(51) Int. Cl.
*F41G 1/35* (2006.01)
*F41G 1/34* (2006.01)
*F41C 23/10* (2006.01)

(52) U.S. Cl.
CPC ..... *F41G 1/35* (2013.01); *F41C 23/10* (2013.01); *F41G 1/345* (2013.01)

(58) Field of Classification Search
CPC ..... F41G 1/35; F41G 1/34
USPC ..... 42/117, 114
See application file for complete search history.

(56) References Cited

U.S. PATENT DOCUMENTS

| | | | | |
|---|---|---|---|---|
| 4,934,086 | A * | 6/1990 | Houde-Walter | F41A 3/86 362/110 |
| 5,706,600 | A | 1/1998 | Toole et al. | |
| 7,260,910 | B2 | 8/2007 | Danielson | |
| 7,805,876 | B1 * | 10/2010 | Danielson | F41C 23/10 362/114 |
| 8,156,677 | B2 | 4/2012 | Glock | |
| 8,807,779 | B1 * | 8/2014 | Izumi | F41G 1/34 362/109 |
| 9,453,702 | B2 * | 9/2016 | Bruhns | F41C 23/10 |
| 9,791,240 | B2 * | 10/2017 | Bruhns | F41C 23/10 |
| 9,909,830 | B1 * | 3/2018 | Toole | F41A 35/02 |
| 10,088,269 | B2 * | 10/2018 | Sheets, Jr. | F41C 23/10 |

OTHER PUBLICATIONS

LaserMax, LaserMax Sabre, frame mount laser sight for Glock, retrieved Jul. 16, 2018, product was commercialy available (currently no longer available) and could be located at https://www.opticsplanet.com/lasermax-laser-sights-sabre-frame-mount-for-glock.html on Jul. 19, 2012.

* cited by examiner

*Primary Examiner* — Reginald S Tillman, Jr.
(74) *Attorney, Agent, or Firm* — Kolisch Hartwell, P.C.

(57) ABSTRACT

A laser sighting device for a handgun may include a power supply module and a backstrap having a laser emitter, the power supply module and the backstrap each comprising a portion of an electrical conduction path. When the backstrap is mounted to an external portion of a handgrip and the power supply module is inserted into an existing cavity of the handgrip, the electrical conduction path is automatically completed and the laser emitter is powered by the power supply module.

20 Claims, 10 Drawing Sheets

GRIP-MOUNTED LASER SIGHT FOR A HANDGUN

CROSS-REFERENCES

This application claims the benefit under 35 U.S.C. § 119(e) of the priority of U.S. Provisional Patent Application Ser. No. 62/533,049, filed Jul. 15, 2017, the entirety of which is hereby incorporated by reference for all purposes.

FIELD

This disclosure relates to systems and methods for providing laser sights for firearms. More specifically, the disclosed embodiments relate to improved backstrap-style laser sighting devices that can be incorporated into existing handguns.

INTRODUCTION

The popularity and usefulness of laser sighting devices integrated into firearm handgrips have grown over the past several years. When using firearms, it is often advantageous for the user to be able to quickly and accurately align the firearm with the target. Many devices are available to assist with aiming, including the classic V-sight, peephole sight, 3-dot sight and similar iron-sight structures, as well as telescopic or optical sights.

However, in low light situations (e.g., at night, in darkened rooms of buildings, etc.), a sighting device that relies on ambient light is at a disadvantage. Under such conditions, the target may itself be difficult to acquire or track visually. Furthermore, gunsights that are lit only by external light sources are less effective due to the need to see and align the sights with the already poorly-perceived target.

Existing laser sight solutions add significant bulk and width to the handgun grip and/or require significant permanent modification to the lower frame of the handgun. Accordingly, a need exists for a laser sighting device that is attachable to the handgrip without requiring substantial modification of the firearm, and that does not increase the outer width of the handgun grip.

SUMMARY

The present disclosure provides systems, apparatuses, and methods relating to improved laser sighting devices for use with handguns and other firearms. In some embodiments, a laser sighting device for a firearm may include a backstrap including a laser emitter, a first electrical conduction path, and a switch configured to selectively connect the laser emitter to the first electrical conduction path; and a battery holder including a second electrical conduction path; wherein the laser sighting device is transitionable between (a) an operational configuration, in which the battery holder is inserted into an open cavity of a handgrip of the firearm adjacent a magazine well of the firearm, the backstrap is coupled to an external surface of the handgrip, and the first electrical conduction path is electrically connected to the second electrical conduction path, and (b) a detached configuration, in which the battery holder and the backstrap are separated from the handgrip.

In some embodiments, a laser sighting device for a firearm may include a backstrap configured to be attachable to an external surface of a handgrip of a firearm, the backstrap including a laser emitter and a manually-operated switch configured to selectively activate the laser emitter; a battery holder configured to be insertable into an open cavity disposed adjacent a magazine well of the firearm; and an electrical conduction path configured to electrically couple the backstrap to the battery holder.

In some embodiments, a method of providing a laser sight for a handgun may include coupling a backstrap to a handgrip of the handgun, the backstrap including a laser emitter and a hand-operated switch coupled to the laser emitter; inserting a battery holder and a battery into an open-mouthed cavity of the handgrip of the handgun, the open-mouthed cavity being disposed adjacent a magazine well of the handgun; forming an electrical conduction path from the battery to the laser emitter, such that the switch is configured to activate the laser emitter by selectively coupling the laser emitter to the electrical conduction path.

Features, functions, and advantages may be achieved independently in various embodiments of the present disclosure, or may be combined in yet other embodiments, further details of which can be seen with reference to the following description and drawings.

DETAILED DESCRIPTION

Figure 1:
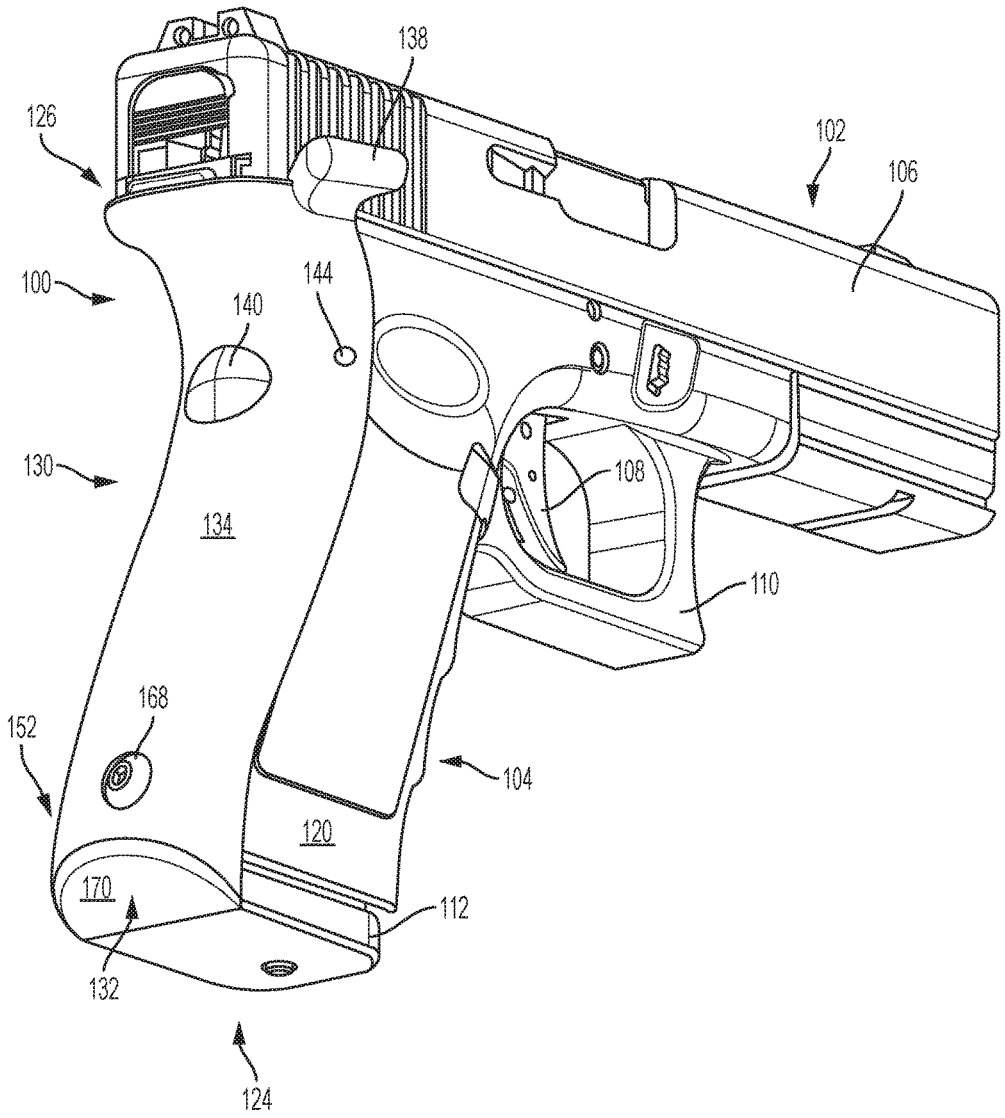
FIG. 1 is an isometric view of an illustrative handgun including an illustrative backstrap laser sighting device in accordance with aspects of the present disclosure.
Figure 2:
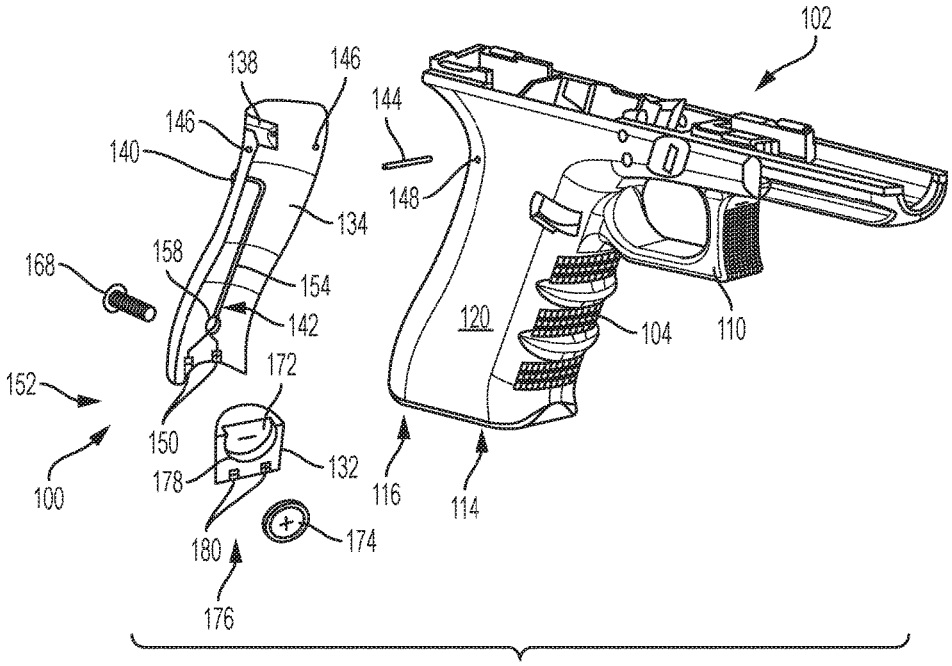
FIG. 2 is an exploded view of portions of the handgun and backstrap laser sighting device of FIG. 1.
Figure 3:
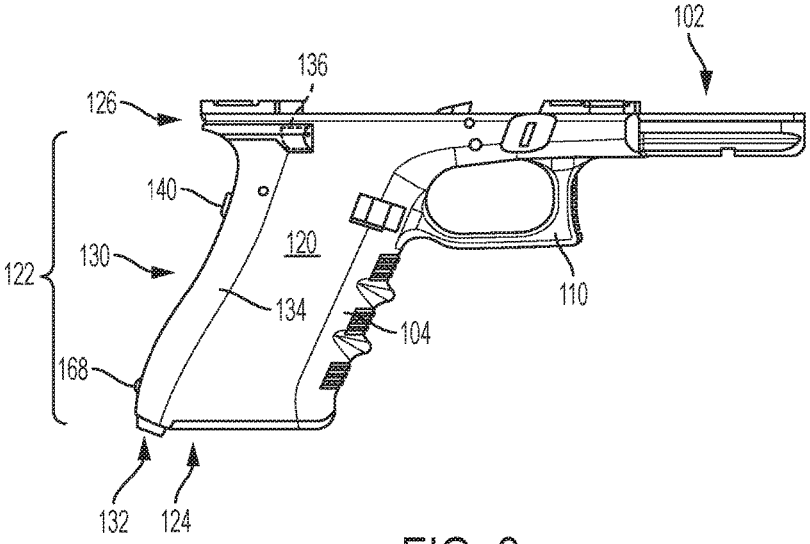
FIG. 3 is a side elevation view of a lower portion of the handgun and backstrap laser sighting device of FIG. 1.
Figure 4:
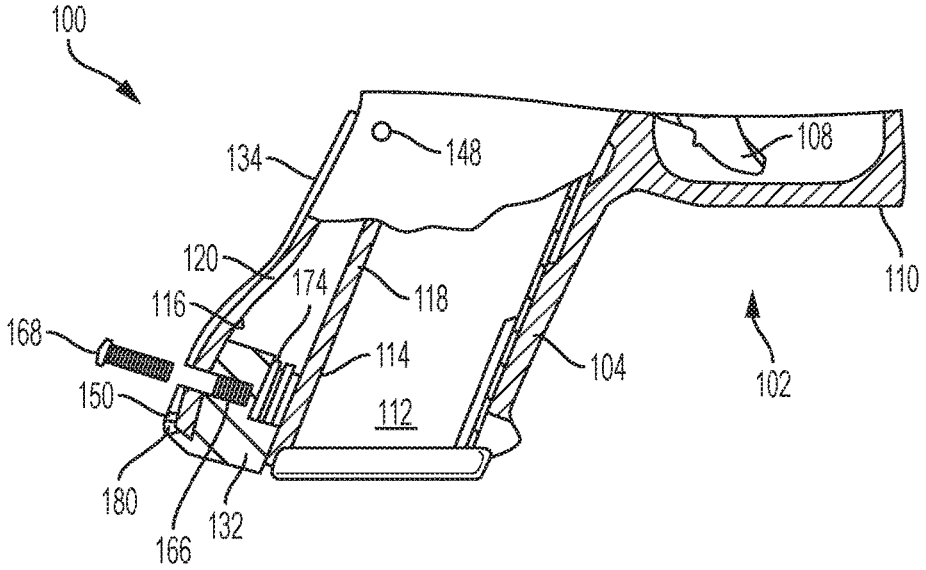
FIG. 4 is a partial sectional view of a portion of the handgun and backstrap laser sighting device of FIG. 1, viewed from the right side of the handgun.
Figure 5:
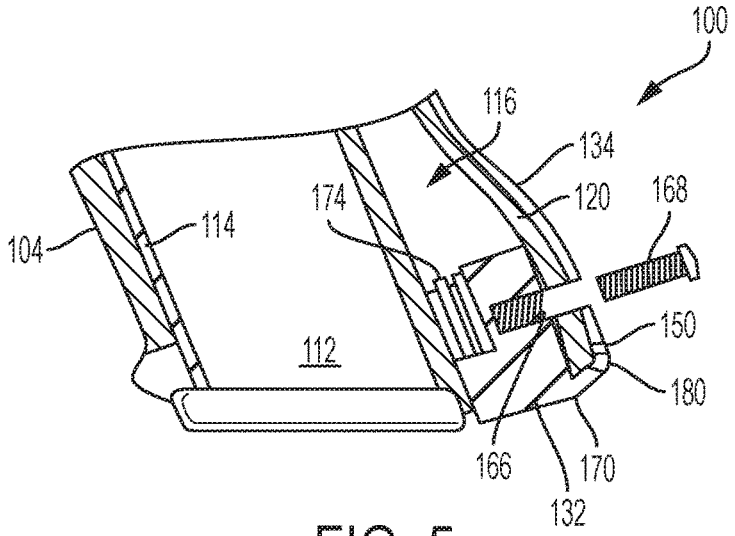
FIG. 5 is a partial sectional view of a handgrip portion of the handgun and backstrap laser sighting device of FIG. 1, viewed from the left side of the handgun

Various aspects and examples of an aftermarket, backstrap-style laser sighting device, as well as related systems and methods, are described below and illustrated in the associated drawings. Unless otherwise specified, a laser sighting device in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through D, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

Directional terms such as "up," "down," "rear," "forward," "vertical," "horizontal," and the like are intended to be understood in the context of a host firearm on which systems described herein may be mounted or otherwise attached. If applicable, the host firearm should be considered as it is held in a typical firing position, such that the barrel of the weapon is substantially horizontal. In the absence of a host firearm, the same directional terms may be used as if the firearm were present. For example, even when viewed in isolation, a component may have a "forward" edge, based on the fact that the edge in question would be installed generally facing the front portion (i.e., muzzle end) of a host firearm.

"Coupled" means connected, either permanently or releasably, whether directly or indirectly through intervening components.

"Resilient" describes a material or structure configured to be deformed elastically under normal operating loads (e.g., when compressed) and to return to an original shape or position when unloaded.

"Rigid" describes a material or structure configured to be stiff, non-deformable, or substantially lacking in flexibility under normal operating conditions.

Overview

In general, laser sighting devices of the present disclosure relate to laser gunsight systems that fit the handgrip of a firearm without requiring significant modification of the firearm. The laser is mounted in a removable backstrap (or side panel) that conforms to the shape of the rear and/or side portion of the handgrip. A power source for the laser emitter includes a removable battery compartment or holder located inside a preexisting cavity of the handgun grip. Electrical terminals on the removable backstrap make contact with terminals on the removable battery compartment located inside the firearm to provide power for the laser.

Laser sighting devices described herein include a backstrap portion configured to be attachable to an external surface of a handgrip of a firearm. The backstrap includes a laser emitter and a manually-operated switch configured to selectively activate the laser emitter. A battery holder (e.g., a separate component from the backstrap) is configured to be insertable into an open cavity disposed adjacent a magazine well of the firearm. An electrical conduction path is configured to electrically couple the backstrap to the battery holder. The electrical conduction path may be divided into a first electrical conduction path portion disposed on the backstrap and a second electrical conduction path portion disposed on the battery holder.

In some embodiments, the first portion of the electrical conduction path protrudes through the handgrip and into the cavity, where it contacts the second portion. In some embodiments, the two portions of the electrical conduction path make contact outside of the cavity, such that the path extends through an open mouth of the cavity and does not pass through the wall of the handgrip.

Laser sighting devices described herein may be mounted on the handgrip of a firearm. These devices include a backstrap portion having a compartment for holding a laser emitter, such that the laser emitter propagates a beam of laser light substantially in the muzzle direction of the firearm. A switch is disposed in the backstrap (or elsewhere) for activation of the laser by the user's hand while holding the handgrip in a firing position. A power supply module (e.g., a battery holder) is used to power the laser, and is disposed inside the handgun (e.g., in an existing cavity). An electrical circuit is formed between the internally mounted power supply module and the externally mounted laser. The switch and circuit are contained within an integrated assembly that may be attached to the handgrip of the firearm without requiring substantial modification of the firearm. In some examples, no modification is required. In some examples, a hole may be formed (e.g., drilled) through the wall of the handgrip and into the cavity.

Although weapons and firearms (e.g., pistols and handguns) are referenced for efficiency of explanation throughout this disclosure, laser sighting devices according to the present teachings may be used with any suitable device that has a handgrip and that may benefit from a laser sight (e.g., air guns, paintball guns, BB guns, pellet guns, replica guns, rifles and machine guns having pistol grips, slingshots, tools such as infrared thermometers and long-range microphones, aimable optical devices such as telescopes, and the like).

Examples, Components, and Alternatives

The following sections describe selected aspects of exemplary laser sighting devices as well as related systems and/or methods. The examples in these sections are intended for illustration and should not be interpreted as limiting the scope of the present disclosure. Each section may include one or more distinct embodiments or examples, and/or contextual or related information, function, and/or structure.

A. First Illustrative Laser Sighting Device

As shown in FIGS. 1-7, this section describes an illustrative removable laser sighting device 100 having a power source disposed internal to the host handgun. Laser sighting device 100 is an example of the laser sighting device described in the Overview section, above.

FIG. 1 depicts laser sighting device 100 mounted on a firearm 102. In this example, the firearm is a Glock semi-automatic handgun (e.g., a Glock model 17, 171, 18, 19, 20, 21, or 22) manufactured by Glock, GmbH, of Austria. Other suitable firearms may be utilized with devices of the present disclosure.

With reference to FIGS. 1-5, firearm 102 includes a handgrip 104, a muzzle 106, a trigger 108, and a trigger guard 110. A magazine 112 for holding ammunition is insertable into a magazine well 114 of the firearm. Firearms such as the Glock handgun include an open cavity 116 adjacent magazine well 114. Cavity 116 has an open mouth or entrance at the bottom of the handgrip, and is separated from magazine well 114 by an internal wall 118. Handgrip 104 includes an external wall 120, which defines the general shape of the handgrip. For example, handgrip 104 has an overall length 122 extending generally from a base 124 (or butt) of the handgrip to an upper tang 126.

Laser sighting device 100 includes a backstrap assembly 130 (AKA the backstrap portion) and a power supply module in the form of a battery holder 132. Backstrap assembly 130 includes a backstrap body 134, a laser emitter 136 housed in a laser emitter housing 138, and a manually operated pushbutton or switch 140 coupled to a first electrical conduction path 142. Backstrap body 134 is an elongate curved structure that is shaped to conform to a rear surface of handgrip 104. In this example, a length of the backstrap body corresponds with length 122 of the handgrip, such that the backstrap body extends to the base of handgrip 104 when installed.

Backstrap assembly 130 is attachable to handgrip 104 by inserting a pin 144 through holes 146 in backstrap body 134 and corresponding holes 148 in handgrip 104, although any suitable attachment method may be utilized. When installed on firearm 102, i.e., in an operational configuration, laser emitter 136 (AKA the laser module) of backstrap assembly 130 is held by housing 138 in an orientation that substantially aligns a laser beam of emitter 136 with the direction of muzzle 106 (i.e., for targeting purposes). Laser emitter 136 may include any suitable laser emitting device, such as a class III laser emitter, of any suitable power, such as 5 mW, and any suitable color laser beam (e.g., red or green). The laser module may include a driver circuit configured to regulate current to laser emitter 136. In some examples, a laser may be used that does not require a driver circuit.

Switch 140 is disposed in any position where it is easily operable by the user when holding firearm 102 in a firing position. For example, the switch may be adjacent the trigger guard or the switch may be manually operable on a rear surface of backstrap body 134. Switch 140 is coupled to first electrical conduction path 142, and controls activation of laser emitter 136. Any suitable switch may be utilized, including a normally-open pushbutton or a push-to-toggle switch. In some examples, switch 240 may be in wireless communication with laser emitter 236 (e.g., using Bluetooth® wireless technology).

Figure 6:
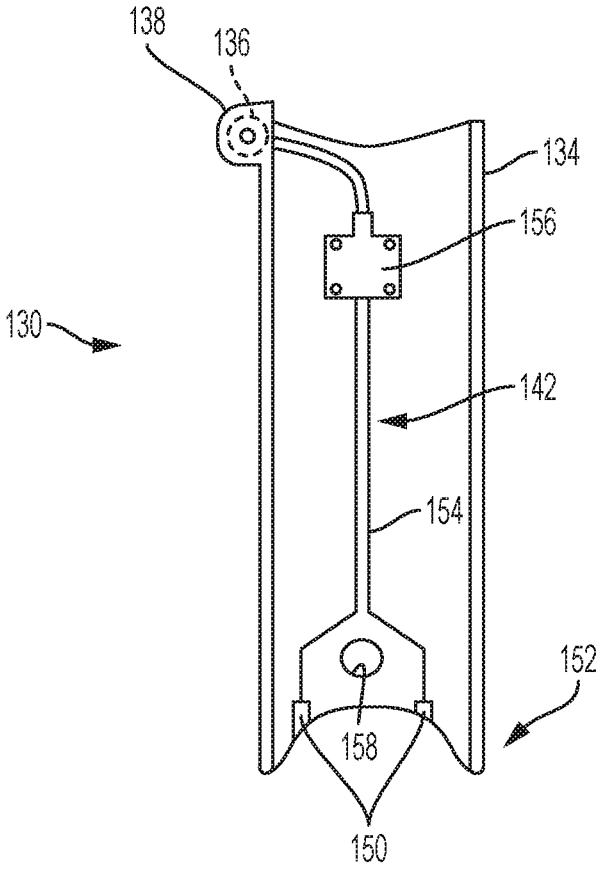
FIG. 6 is a front elevation view of an illustrative backstrap portion of a laser sighting device according to the present teachings.

First conduction path 142 includes a pair of terminals 150 at a base end 152 of backstrap assembly 130, coupled to electrical conductors 154. Conductors 154 travel along a handgrip-facing surface of the backstrap body and connect the terminals to the switch and laser emitter. As shown in FIG. 6, a cover plate 156 secures switch 140 in place. An aperture 158 is formed in a lower portion of the backstrap, and is configured to align with a corresponding aperture 160, which passes through wall 120 of handgrip 104. Aperture 160 is an existing hole in firearm 102.

Battery holder 132 (AKA a battery compartment) includes a base portion 170 and a battery interface portion 172 configured to hold one or more batteries 174 (e.g., coin cell batteries or the like). Battery interface portion 172 is further configured to fit within cavity 116, which is present, e.g., in most or all current Glock handgun models. In some examples, battery interface portion 172 includes a threaded hole 166 that aligns with hole 160, such that the battery holder can be secured in place using a threaded screw 168.

Battery holder 132 further includes a second electrical conduction path 176 having a pair of conductors 178 connecting batteries 174 to a pair of electrical terminals 180 at a rear of base portion 170 of the battery holder. Electrical terminals 180 are configured to mate with electrical terminals 150 on backstrap assembly 130, such that first electrical conduction path 142 and second electrical conduction path 176 are connectible to form a single circuit and provide power to laser emitter 136. Base portion 170 includes a flange or flange-like lip that extends rearward to interface with terminals 150 of the backstrap. Accordingly, in this example, the electrical connection between the two electrical conduction paths (i.e., at the mated terminals) is disposed outside of the cavity of the handgrip, and the electrical circuit extends out of the mouth of the cavity and up to the laser emitter via conductors 178 and 154.

Figure 7:
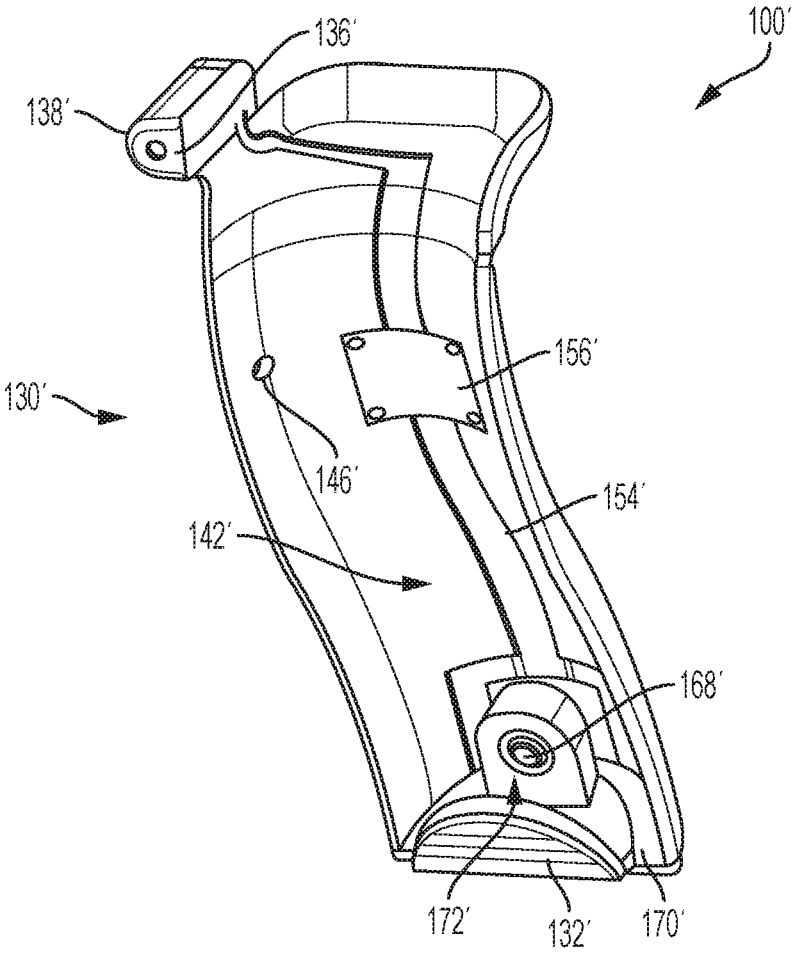
FIG. 7 is an isometric view of another illustrative backstrap portion and battery holder portion of a laser sighting device according to the present teachings.

FIG. 6 is a front elevation view of backstrap assembly 130. FIG. 7 depicts another embodiment of laser sighting device 100, generally indicated at 100'. Laser sighting device 100' is substantially similar to device 100, with corresponding components being described as above and labeled with corresponding primed reference numerals (i.e., a backstrap assembly 130' including a laser emitter 136', a housing 138', a first electrical conduction path 142', holes 146', conductors 154', and a cover plate 156', a screw 168', and a battery holder 132' having a base portion 170', and a battery interface portion 172'). In this example, an upper end of the backstrap assembly is shaped to fit partially around tang 126, and the battery holder is shaped differently as compared with device 100.

In the examples shown in FIGS. 1-7, the backstrap assembly and battery holder are independently attachable and detachable from the handgun. Accordingly, for example, the battery holder may be removed and replaced without disturbing the backstrap assembly and laser (e.g., to conveniently replace the batteries of the device).

In some examples, laser sighting device 100 (or 100') is a single or unitary piece, such that the backstrap assembly is continuous with the battery holder. In these examples, the backstrap body is flexible enough to allow the battery holder to be inserted into the cavity and the backstrap body secured to the handgrip without breaking the electrical conduction path. Accordingly, the material of the backstrap body may be continuous with the material of the battery holder, and the first and second electrical conduction paths may be a continuous circuit rather than being disjointed and disconnectible at the respective terminals.

B. Second Illustrative Laser Sighting Device

As shown in FIGS. 8-11, this section describes an illustrative removable laser sighting device 200 having a power source disposed internal to the host handgun. Laser sighting device 200 is another example of the laser sighting device described in the Overview section, above.

Figure 8:
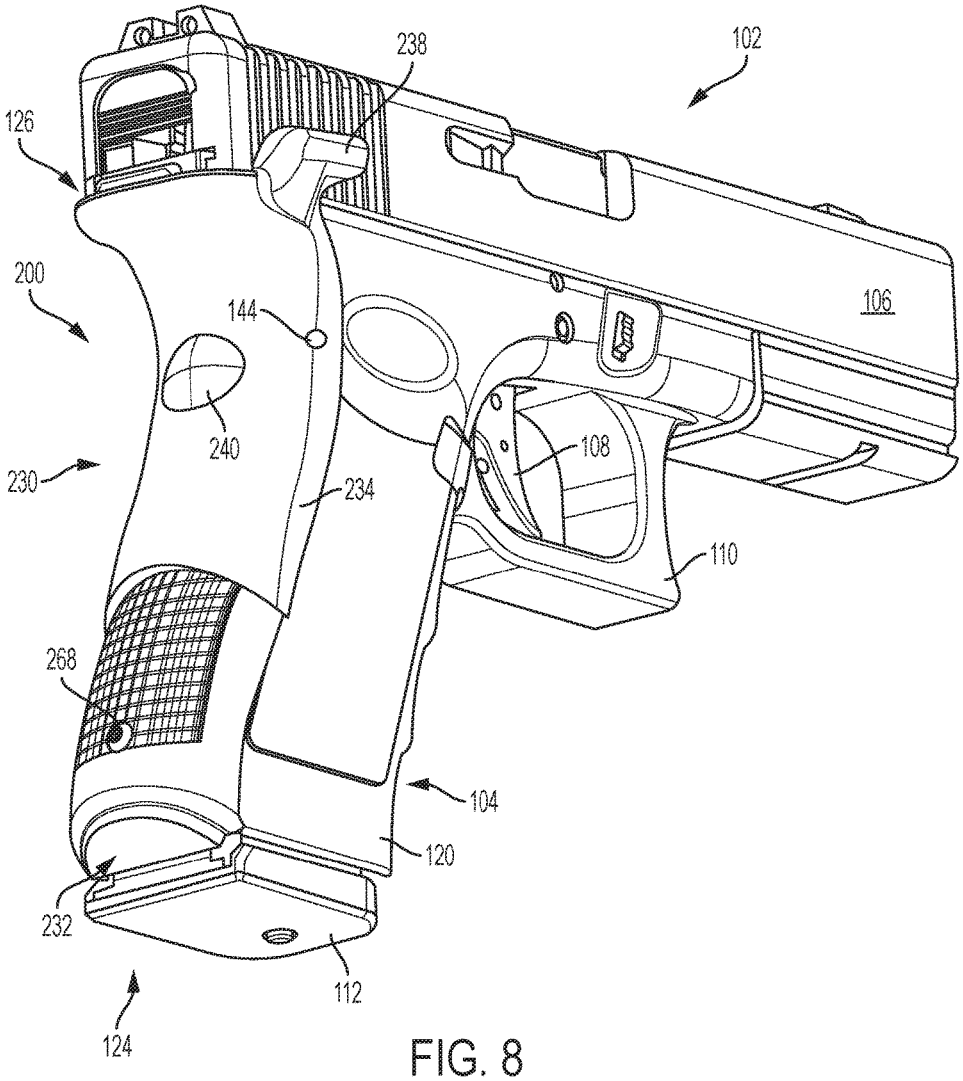
FIG. 8 is an isometric view of an illustrative handgun including another illustrative backstrap laser sighting device in accordance with aspects of the present disclosure.
Figure 9:
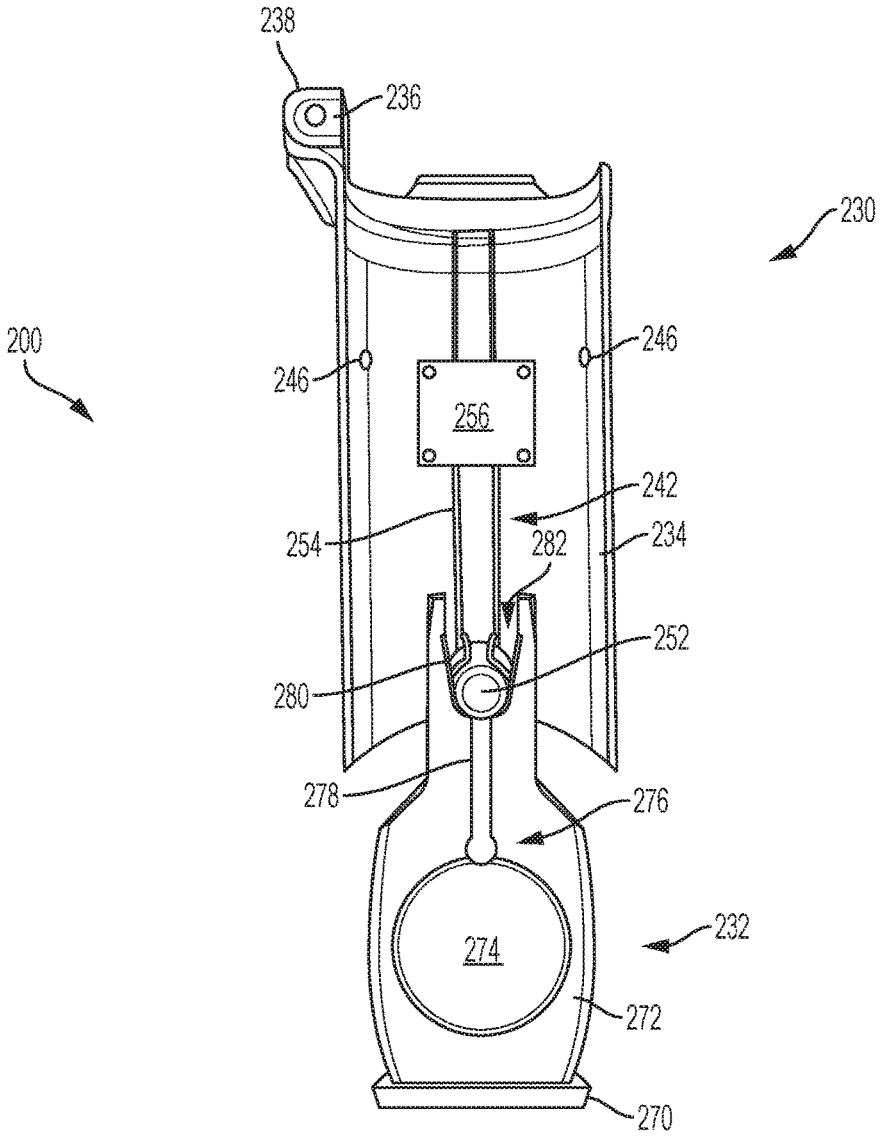
FIG. 9 is a front elevation view of the illustrative backstrap laser sighting device of FIG. 8.
Figure 10:
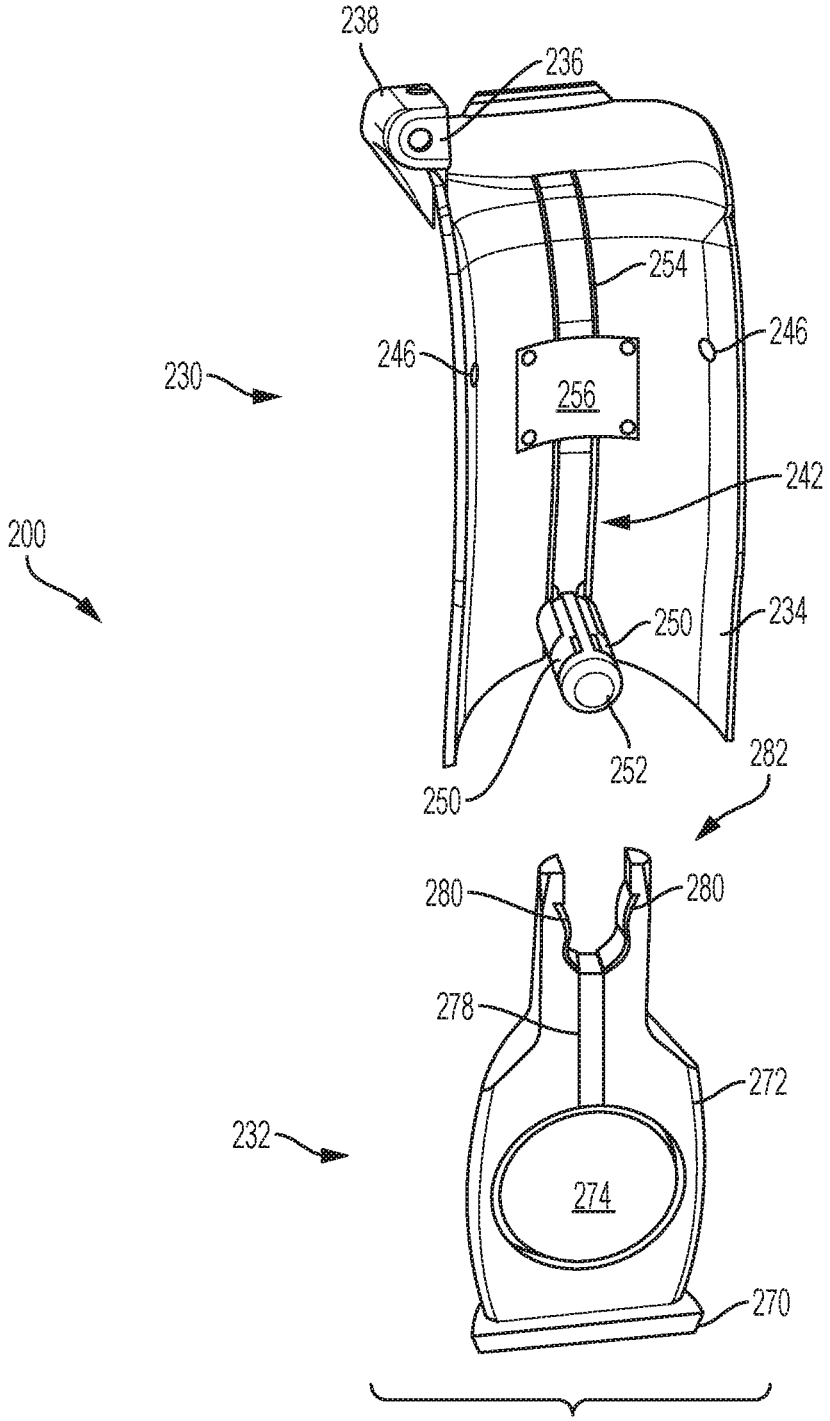
FIG. 10 is an exploded view of the backstrap laser sighting device of FIG. 9.
Figure 11:
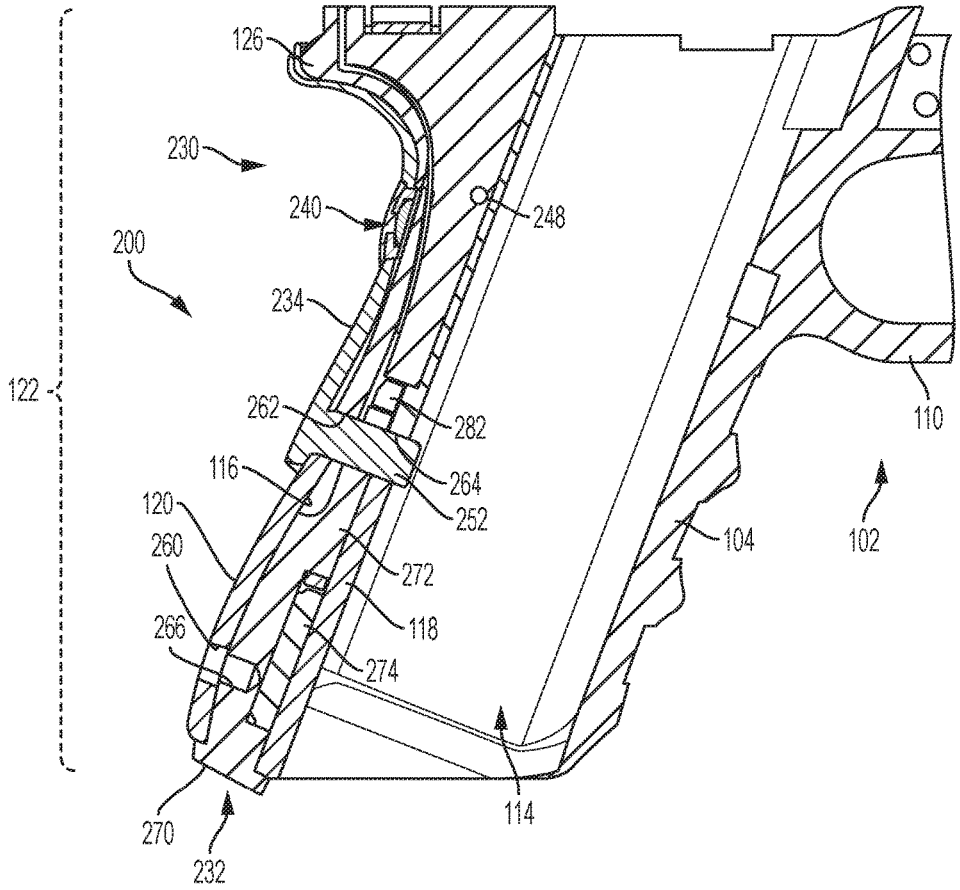
FIG. 11 is a sectional view of a handgrip portion of the handgun of FIG. 8.

FIG. 8 is an isometric view of a handgun incorporating laser sighting device 200; FIG. 9 is a front elevation view of device 200, separated from the handgun; FIG. 10 is an exploded view of FIG. 9; and FIG. 11 is a sectional view of a handgrip portion of a handgun having device 200 in an operational configuration.

FIG. 8 depicts laser sighting device 200 mounted on firearm 102. In this example, the firearm is again a Glock semiautomatic handgun (e.g., a Glock model 17, 171, 18, 19, 20, 21, or 22) manufactured by Glock, GmbH, of Austria. Other suitable firearms may be utilized with devices of the present disclosure.

Laser sighting device 200 includes a backstrap assembly 230 (AKA the backstrap portion) and a power supply module in the form of a battery holder 232. Backstrap assembly 230 includes a backstrap body 234, a laser emitter 236 housed in a laser emitter housing 238, and a manually operated pushbutton or switch 240 coupled to a first electrical conduction path 242. Backstrap body 234 is an elongate curved structure that conforms to a rear surface of handgrip 104. In this example, a length of the backstrap body is shorter than length 122 of the handgrip, such that the backstrap body extends only partially along the length of handgrip 104 when installed. In this embodiment, the backstrap may have a standard length that can be used with handgrips of varying lengths 122 (i.e., with shorter or longer handgrips). In these examples, the size of the battery holder may be varied to compensate for different handgrip lengths.

Backstrap assembly 230 is attachable to handgrip 104 by inserting pin 144 through holes 246 in backstrap body 234 and corresponding holes 148 in handgrip 104, although any suitable attachment method may be utilized. When installed on firearm 102, i.e., in an operational configuration, laser emitter 236 (AKA the laser module) of backstrap assembly 130 is held by housing 238 in an orientation that substantially aligns a laser beam of emitter 236 with the direction of muzzle 106 (i.e., for targeting purposes). Laser emitter 236 may again include any suitable laser emitting device, such as a class III laser emitter, of any suitable power, such as 5 mW, and any suitable color laser beam (e.g., red or green). The laser module may include a driver circuit configured to regulate current to laser emitter 236. In some examples, a laser may be used that does not require a driver circuit.

Switch 240 is disposed in any position where it is easily operable by the user when holding firearm 102 in a firing position. For example, the switch may be adjacent the trigger guard or the switch may be manually operable on a rear surface of backstrap body 234. Switch 240 is coupled to first electrical conduction path 242, and controls activation of laser emitter 236. Any suitable switch may be utilized, including a normally-open pushbutton or a push-to-toggle switch. In some examples, switch 240 may be in wireless communication with laser emitter 236 (e.g., using Bluetooth® wireless technology).

First conduction path 242 includes a pair of terminals 250 disposed on an elongate member 252 of backstrap assembly 230, coupled to electrical conductors 254. Member 252 is configured to protrude in a generally forward direction, through an aperture 262 (AKA a hole) formed in wall 120 of handgrip 104. In some examples, member 252 may further extend through another aperture 264 in internal wall 118 (see, e.g., FIG. 11).

Conductors 254 travel along member 252 and a handgrip-facing surface of the backstrap body, and connect the terminals to the switch and laser emitter. As shown in FIG. 9, a cover plate 256 secures switch 240 in place. An aperture 258 is formed in a lower portion of the backstrap, and is configured to align with corresponding aperture 160, which passes through wall 120 of handgrip 104. As described above, aperture 160 is an existing hole in firearm 102.

Battery holder 232 includes a base portion 270 and a battery interface portion 272 configured to hold one or more batteries 274 (e.g., coin cell batteries or the like). Battery interface portion 272 is further configured to fit within cavity 116, which is present, e.g., in most or all current Glock handgun models. In some examples, battery interface portion 272 includes a threaded hole 266 that aligns with hole 260, such that the battery holder can be secured in place using a threaded screw 268.

Battery holder 232 further includes a second electrical conduction path 276 having a pair of conductors 278 connecting batteries 274 to a pair of electrical terminals 280 disposed on a resilient jaw 282 of the battery holder. Jaw 282 is a two-pronged fork configured to receive a circumference of member 252. Jaw 282 may be resilient, such that member 252 snaps into place through a mouth of the jaw and held in place until sufficient force is used to pull the jaw off of the member. Said another way, the jaw may be configured to approach elongate member 252 from a radial direction and snap onto the outer diameter of the elongate member. As depicted in FIGS. 9 and 10, conductors 254 and 278 are configured to mate, such that first electrical conduction path 242 and second electrical conduction path 276 are connectible to form a single circuit and provide power to laser emitter 236. Base portion 270 includes a flange or flange-like lip that prevents the battery holder from further insertion into cavity 116. Accordingly, in this example, the electrical connection between the two electrical conduction paths (i.e., at the mated terminals) is disposed within the cavity of the handgrip, and the electrical circuit extends through wall 120 of handgrip 104.

In the examples shown in FIGS. 8-11, the backstrap assembly and battery holder are again independently attachable and detachable from the handgun. Accordingly, for example, the battery holder may be removed and replaced without disturbing the backstrap assembly and laser (e.g., to conveniently replace the batteries of the device). Furthermore, the battery holder of device 200 may be temporarily secured in place by the interaction between member 252 and jaw 282, e.g., if the screw is lost or dislodged for some reason. However, the tension holding the jaw to the elongate member may be easily overcome manually and the battery holder may be released and removed from the cavity without moving or removing the elongate member.

Moreover, it may be seen in the above descriptions that laser sighting devices 100 and 200 each provide a two-piece device that establishes an electrical circuit automatically upon assembly. In other words, when the backstrap is coupled to the handgrip surface and the power supply module is inserted into the handgrip cavity, the respective portions of the electrical conduction path are automatically connected without the need for further steps.

C. Illustrative Method

Figure 12:
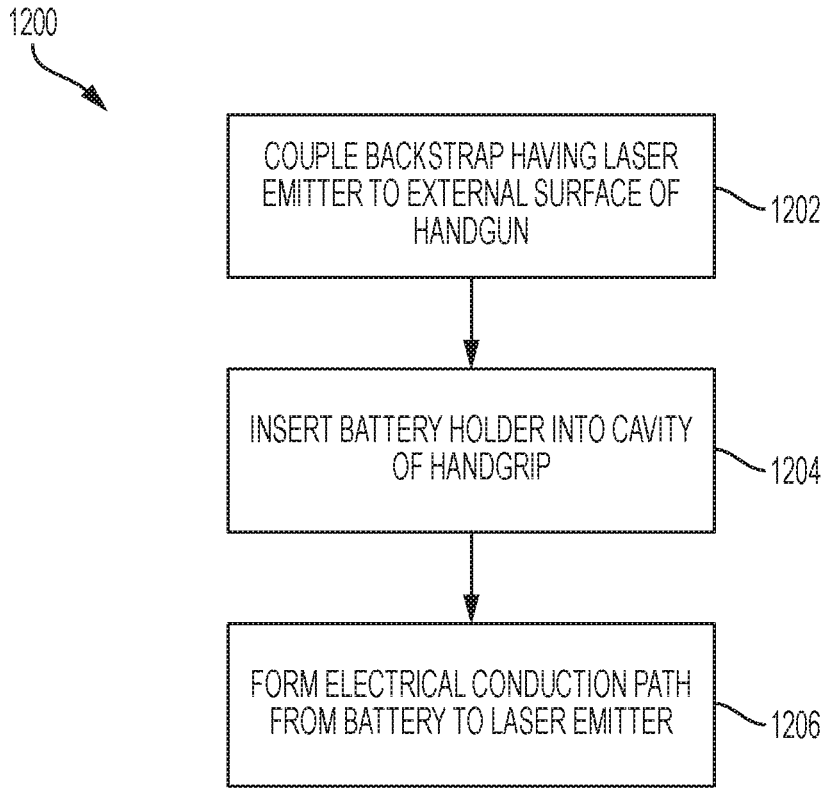
FIG. 12 is a flowchart depicting steps of an illustrative method of providing a laser sight for a firearm.

This section describes steps of an illustrative method 1200 for providing a laser sight for a handgun; see FIG. 12.

Aspects of laser sighting devices and systems described above may be utilized in the method steps described below. Where appropriate, reference may be made to components and systems that may be used in carrying out each step. These references are for illustration, and are not intended to limit the possible ways of carrying out any particular step of the method.

FIG. 12 is a flowchart illustrating steps performed in an illustrative method, and may not recite the complete process or all steps of the method. Although various steps of method 1200 are described below and depicted in FIG. 12, the steps need not necessarily all be performed, and in some cases may be performed simultaneously or in a different order than the order shown.

Step 1202 includes coupling a backstrap to a handgrip of a handgun, the backstrap including a laser emitter and a hand-operated switch coupled to the laser emitter. Coupling the backstrap to the handgrip may be performed using any suitable method, e.g., using an adhesive, a fastener, a retaining clip, and/or the like. As described above, this step may include inserting a pin through mutually-aligned holes in the backstrap and in the handgrip.

Step 1204 includes inserting a battery holder and a battery into an open-mouthed cavity of the handgrip of the handgun, the open-mouthed cavity being disposed adjacent a magazine well of the handgun. In some examples, method 1200 further includes securing the battery holder to the handgrip by inserting a threaded fastener through a second aperture in a rear wall of the handgrip and into a threaded hole of the battery holder.

Step 1206 includes forming an electrical conduction path from the battery to the laser emitter (e.g., automatically), such that the switch is configured to activate the laser emitter by selectively coupling the laser emitter to the electrical conduction path. In some examples, forming the electrical conduction path includes coupling a first portion of the electrical conduction path disposed on the backstrap to a second portion of the electrical conduction path disposed on the battery holder. In some examples, the first portion of the electrical conduction path and the second portion of the electrical conduction path are coupled outside the open-mouthed cavity. The first portion of the electrical conduction path may include first terminals configured to mate with second terminals of the second portion of the electrical conduction path.

In some examples, method 1200 further includes forming a first aperture through a wall of the handgrip and into the open-mouthed cavity. The first portion of the electrical conduction path may then be caused to protrude through the first aperture and into the open-mouthed cavity. Accordingly, the first portion of the electrical conduction path and the second portion of the electrical conduction path may be coupled inside the open-mouthed cavity.

D. Illustrative Combinations and Additional Examples

This section describes additional aspects and features of laser sighting devices according to the present teachings, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A laser sighting device for a firearm, the laser sighting device comprising:

a backstrap configured to be attachable to an external surface of a handgrip of a firearm, the backstrap including a laser emitter and a manually-operated switch configured to selectively activate the laser emitter;

a battery holder configured to be insertable into an open cavity disposed adjacent a magazine well of the firearm; and an electrical conduction path configured to electrically couple the backstrap to the battery holder.

A1. The device of A0, the electrical conduction path comprising a first electrical conduction path portion disposed on the backstrap and a second electrical conduction path portion disposed on the battery holder.

A2. The device of A1, wherein the first electrical conduction path portion is at least partially disposed on an elongate member extending from the backstrap, such that the elongate member is configured to protrude into the open cavity of the handgrip through an aperture formed in a wall of the handgrip.

A3. The device of A1, wherein the first electrical conduction path portion is configured to extend into the open cavity.

A4. The device of A1, wherein the first electrical conduction path portion comprises first terminals configured to form an electrical connection with second terminals of the second electrical conduction path portion.

A5. The device of A4, wherein the electrical connection is disposed external to the handgrip.

A6. The device of A4, wherein the electrical connection is disposed within the open cavity.

A7. The device of A0, wherein the electrical conduction path is configured to form a circuit between the laser emitter and a battery of the battery holder.

A8. The device of A0, further comprising a battery disposed in the battery holder.

A9. The device of A0, wherein the backstrap and the battery holder are permanently affixed to each other.

B0. A laser sighting device for a firearm, the laser sighting device comprising:

a backstrap including a laser emitter, a first electrical conduction path, and a switch configured to selectively connect the laser emitter to the first electrical conduction path; and a battery holder including a second electrical conduction path;

wherein the laser sighting device is transitionable between (a) an operational configuration, in which the battery holder is inserted into an open cavity of a handgrip of the firearm adjacent a magazine well of the firearm, the backstrap is coupled to an external surface of the handgrip, and the first electrical conduction path is electrically connected to the second electrical conduction path, and (b) a detached configuration, in which the battery holder and the backstrap are separated from the handgrip.

B1. The device of B0, wherein the backstrap and the battery holder form a unitary assembly in both the operational configuration and the detached configuration.

B2. The device of B0, wherein the first electrical conduction path of the backstrap includes first electrical terminals, and the second electrical conduction path of the battery holder includes second electrical terminals configured to mate with the first electrical terminals.

B3. The device of B2, wherein the first electrical terminals and the second electrical terminals are disposed within the cavity of the firearm handgrip when the laser sighting device is in the operational configuration.

B4. The device of B3, wherein the backstrap further comprises an elongate member configured to pass through an aperture in a wall of the firearm handgrip, and the first electrical terminals are disposed on the elongate member.

B5. The device of B4, wherein battery holder further comprises a jaw configured to receive the elongate member, and the second electrical terminals are disposed on the jaw.

B6. The device of B5, wherein the jaw is resilient and configured to circumferentially retain the elongate member.

B7. The device of B2, wherein the first electrical terminals and second electrical terminals are connected to each other and disposed external to the handgrip when the laser sighting device is in the operational configuration.

C0. A firearm comprising:

a handgrip including a magazine well and a cavity having an open mouth adjacent the magazine well;

a removable backstrap coupled to the handgrip, the backstrap including a laser emitter and a switch configured to selectively activate the laser emitter;

a removable battery holder disposed in the cavity of the handgrip; and an electrical conduction path electrically coupling the battery holder and the switch of the backstrap.

C1. The firearm of C0, wherein the electrical conduction path passes through a first aperture in a wall of the handgrip.

C2. The firearm of C1, the backstrap further comprising an elongate member protruding through the first aperture, wherein a first portion of the electrical conduction path is disposed on the elongate member.

C3. The firearm of C2, the battery holder further comprising a jaw configured to receive the elongate member, wherein a second portion of the electrical conduction path is disposed on the jaw.

C4. The firearm of C0, wherein the electrical conduction path passes through the open mouth of the cavity.

C5. The firearm of C0, wherein the backstrap extends along an entire length of the handgrip.

C6. The firearm of C0, wherein the battery holder is secured to the handgrip by a fastener passing through a second aperture in a wall of the handgrip.

C7. The firearm of C6, wherein the fastener comprises a screw.

C8. The firearm of C0, wherein the firearm comprises a pellet gun.

C9. The firearm of C0, wherein the firearm comprises a handgun.

D0. A method of providing a laser sight for a handgun, the method comprising:

coupling a backstrap to a handgrip of the handgun, the backstrap including a laser emitter and a hand-operated switch coupled to the laser emitter;

inserting a battery holder and a battery into an open-mouthed cavity of the handgrip of the handgun, the open-mouthed cavity being disposed adjacent a magazine well of the handgun; and forming an electrical conduction path from the battery to the switch, such that the switch is configured to activate the laser emitter by selectively coupling the laser emitter to the electrical conduction path.

D1. The method of D0, wherein forming the electrical conduction path comprises coupling a first portion of the electrical conduction path disposed on the backstrap to a second portion of the electrical conduction path disposed on the battery holder.

D2. The method of D1, wherein the first portion of the electrical conduction path and the second portion of the electrical conduction path are coupled inside the open-mouthed cavity.

D3. The method of D2, further comprising forming a first aperture through a wall of the handgrip and into the open-mouthed cavity.

D4. The method of D3, further comprising causing the first portion of the electrical conduction path to protrude through the first aperture and into the open-mouthed cavity.

D5. The method of D1, wherein the first portion of the electrical conduction path and the second portion of the electrical conduction path are coupled outside the open-mouthed cavity.

D6. The method of D5, wherein the first portion of the electrical conduction path comprises first terminals configured to mate with second terminals of the second portion of the electrical conduction path.

D7. The method of D0, wherein coupling the backstrap to the handgrip comprises inserting a pin through mutually-aligned holes in the backstrap and in the handgrip.

D8. The method of D0, further comprising securing the battery holder to the handgrip by inserting a threaded fastener through a second aperture in a rear wall of the handgrip and into a threaded hole of the battery holder.

D9. The method of D0, further comprising removing the battery holder from the cavity while the backstrap remains in place on the handgrip (e.g., to replace the batteries).

D10. The method of D0, wherein forming the electrical conduction path from the battery to the switch is automatic upon completion of coupling the backstrap to the handgrip and inserting the battery holder into the open-mouthed cavity.

Advantages, Features, and Benefits

The different embodiments and examples of the laser sighting devices described herein provide several advantages over known solutions. For example, illustrative embodiments and examples described herein allow handgun handgrips of varying length to be accommodated by a single size of backstrap, while varying the length of the battery compartment. This simplifies the manufacturing process.

Additionally, and among other benefits, illustrative embodiments and examples described herein provide an easy to install laser sighting device that takes advantage of an existing aperture and cavity of known handguns.

Additionally, and among other benefits, illustrative embodiments and examples described herein provides an externally-mounted laser sighting device that has a power source internal to the handgun.

Additionally, and among other benefits, illustrative embodiments and examples described herein provide a laser sighting device that is attachable and removable from the handgun using only a screwdriver.

Additionally, and among other benefits, illustrative embodiments and examples described herein provide a laser sighting device that is attachable and removable from the handgun with little or no modification to the handgun itself.

Additionally, and among other benefits, illustrative embodiments and examples described herein have a backstrap and a battery holder that are independently attachable and detachable from the handgun, e.g., allowing the batteries to be changed without removing the laser portion of the device. This avoids causing misadjustment of the laser emitter.

Additionally, and among other benefits, illustrative embodiments and examples described herein automatically connect the respective electrical conduction paths of the backstrap and the battery holder upon installation (i.e., without additional connecting steps required). For example, in device 100 the terminals match up and mate together automatically. In device 200, mating of the member and jaw automatically connects the respective electrical conductors.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A laser sighting device for a firearm, the laser sighting device comprising:

a backstrap including a laser emitter, a first electrical conduction path, and a switch configured to selectively connect the laser emitter to the first electrical conduction path; and a battery holder including a second electrical conduction path;

wherein the laser sighting device is transitionable between (a) an operational configuration, in which the battery holder is inserted into an open cavity of a handgrip of the firearm adjacent a magazine well of the firearm, the backstrap is coupled to an external surface of the handgrip, and the first electrical conduction path is electrically connected to the second electrical conduction path, and (b) a detached configuration, in which the battery holder and the backstrap are separated from the handgrip.

2. The device of claim 1, wherein the first electrical conduction path of the backstrap includes first electrical terminals, and the second electrical conduction path of the battery holder includes second electrical terminals configured to mate with the first electrical terminals.

3. The device of claim 2, wherein the first electrical terminals and the second electrical terminals are disposed within the cavity of the firearm handgrip when the laser sighting device is in the operational configuration.

4. The device of claim 3, wherein the backstrap further comprises an elongate member configured to pass through an aperture in a wall of the firearm handgrip, and the first electrical terminals are disposed on the elongate member.

5. The device of claim 4, wherein battery holder further comprises a jaw configured to receive the elongate member, and the second electrical terminals are disposed on the jaw.

6. The device of claim 2, wherein the first electrical terminals and second electrical terminals are connected to each other and disposed external to the handgrip when the laser sighting device is in the operational configuration.

7. The device of claim 1, wherein the backstrap and the battery holder form a unitary component in both the operational configuration and the detached configuration.

8. A laser sighting device for a firearm, the laser sighting device comprising:

a backstrap configured to be attachable to an external surface of a handgrip of a firearm, the backstrap including a laser emitter and a manually-operated switch configured to selectively activate the laser emitter;

a battery holder configured to be insertable into an open cavity disposed adjacent a magazine well of the firearm; and an electrical conduction path configured to electrically couple the backstrap to the battery holder.

9. The device of claim 8, the electrical conduction path comprising a first electrical conduction path portion disposed on the backstrap and a second electrical conduction path portion disposed on the battery holder.

10. The device of claim 9, wherein the first electrical conduction path portion is at least partially disposed on an elongate member extending from the backstrap, such that the elongate member is configured to protrude into the open cavity of the handgrip through an aperture formed in a wall of the handgrip.

11. The device of claim 9, wherein the first electrical conduction path portion is configured to extend into the open cavity.

12. The device of claim 9, wherein the first electrical conduction path portion comprises first terminals configured to form an electrical connection with second terminals of the second electrical conduction path portion.

13. The device of claim 12, wherein the electrical connection is disposed external to the handgrip.

14. The device of claim 12, wherein the electrical connection is disposed within the open cavity.

15. The device of claim 8, wherein the backstrap and the battery holder are permanently affixed to each other.

16. A method of providing a laser sight for a handgun, the method comprising:

coupling a backstrap to a handgrip of the handgun, the backstrap including a laser emitter and a hand-operated switch coupled to the laser emitter;

inserting a battery holder and a battery into an open-mouthed cavity of the handgrip of the handgun, the open-mouthed cavity being disposed adjacent a magazine well of the handgun; and forming an electrical conduction path from the battery to the laser emitter, such that the switch is configured to activate the laser emitter by selectively coupling the laser emitter to the electrical conduction path.

17. The method of claim 16, wherein forming the electrical conduction path comprises coupling a first portion of the electrical conduction path disposed on the backstrap to a second portion of the electrical conduction path disposed on the battery holder.

18. The method of claim 17, wherein the first portion of the electrical conduction path and the second portion of the electrical conduction path are coupled inside the open-mouthed cavity.

19. The method of claim 18, further comprising causing the first portion of the electrical conduction path to protrude through an aperture of the handgrip and into the open-mouthed cavity.

20. The method of claim 17, wherein the first portion of the electrical conduction path and the second portion of the electrical conduction path are coupled outside the open-mouthed cavity.

* * * * *